US011325391B2

(12) United States Patent
Neeb et al.

(10) Patent No.: US 11,325,391 B2
(45) Date of Patent: May 10, 2022

(54) METHOD FOR OPERATING A PRINTING MATERIAL PROCESSING MACHINE BY APPLYING A VARNISH CONSUMPTION PREDICTION

(71) Applicant: HEIDELBERGER DRUCKMASCHINEN AG, Heidelberg (DE)

(72) Inventors: Steffen Neeb, Bensheim (DE); Nicklas Raymond Norrick, Heddesheim (DE); Andreas Henn, Neckargemuend (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 43 days.

(21) Appl. No.: 16/885,520

(22) Filed: May 28, 2020

(65) Prior Publication Data

US 2020/0376850 A1 Dec. 3, 2020

(30) Foreign Application Priority Data

May 28, 2019 (DE) ..... 102019207839

(51) Int. Cl.
*B41F 33/16* (2006.01)
*B41J 2/175* (2006.01)

(52) U.S. Cl.
CPC ..... *B41J 2/17566* (2013.01); *B41F 33/16* (2013.01); *B41J 2/17503* (2013.01); *B41J 2002/17569* (2013.01); *B41P 2233/30* (2013.01)

(58) Field of Classification Search
CPC ..... B41J 2/17566; B41J 2002/17569; B41F 33/16; B41P 2233/30
See application file for complete search history.

(56) References Cited

U.S. PATENT DOCUMENTS 6,233,410 B1 * 5/2001 Seber ..... B41L 13/06 399/12
6,520,621 B1 * 2/2003 Eckard ..... B41J 2/16547 347/33
9,802,420 B2 10/2017 Guelck
9,898,232 B2 2/2018 Has et al.
10,649,449 B2 5/2020 Bell et al.
2004/0252324 A1 12/2004 Ohta
(Continued)

FOREIGN PATENT DOCUMENTS

CN 109376934 A * 2/2019
DE 19928200 A1 12/2000
(Continued)

*Primary Examiner* — Sharon Polk
(74) *Attorney, Agent, or Firm* — Laurence A. Greenberg; Werner H. Stemer; Ralph E. Locher

(57) ABSTRACT

A method for operating a printing material processing machine by using a computer includes acquiring print job parameters from print jobs for the printing material processing machine and machine parameters by using the computer, evaluating the acquired parameters to determine the machine state by using the computer, and requesting and providing fluid consumable materials for optimizing the operation of the machine on the basis of the determined machine state by using the computer. Maintenance measures carried out on the machine are optimized on the basis of the determined machine state, by using the computer.

5 Claims, 2 Drawing Sheets

(56) References Cited

U.S. PATENT DOCUMENTS

| | | | | |
|---|---|---|---|---|
| 2010/0085395 | A1* | 4/2010 | Shimoda | B41J 2/04596 347/6 |
| 2012/0226948 | A1 | 9/2012 | Itogawa | |
| 2016/0334744 | A1 | 11/2016 | Nogami | |
| 2017/0046104 | A1* | 2/2017 | Van Vonderen | G06F 3/1256 |
| 2020/0276799 | A1 | 9/2020 | D'Annunzio | |

FOREIGN PATENT DOCUMENTS

| | | | |
|---|---|---|---|
| DE | 102005058768 | A1 | 6/2007 |
| DE | 102015101370 | A1 | 8/2015 |
| DE | 102014217775 | A1 | 3/2016 |
| DE | 102014116089 | A1 | 5/2016 |
| DE | 102015118139 | A1 | 10/2016 |
| DE | 102015223032 | A1 | 5/2017 |
| DE | 102017205576 | A1 | 10/2018 |
| EP | 1127688 | A1 | 8/2001 |
| EP | 2743870 | A1 | 6/2014 |
| EP | 3608104 | A1 | 2/2020 |
| JP | 2008258897 | A | 10/2008 |
| JP | 2017126638 | A | 7/2017 |
| WO | 2019057342 | A1 | 3/2019 |

* cited by examiner

METHOD FOR OPERATING A PRINTING MATERIAL PROCESSING MACHINE BY APPLYING A VARNISH CONSUMPTION PREDICTION

CROSS-REFERENCE TO RELATED APPLICATION

This application claims the priority, under 35 U.S.C. § 119, of German Patent application DE 10 2019 207 839, filed May 28, 2019; the prior application is herewith incorporated by reference in its entirety.

BACKGROUND OF THE INVENTION

Field of the Invention

The present invention relates to a method for operating a printing material processing machine by applying a consumption prediction model.

The invention lies in the technical field of preventive maintenance.

In general, approaches to the predictive maintenance of industrial printing presses are substantially based on the data which are produced and collected in the field by the individual printing presses, in order to ensure that the data can be subsequently subjected to central evaluation. In such big-data applications, as they are known, the aim is to detect and to evaluate as many sensors and changes on a printing press as possible.

Specifically, it is often a problem during operation of varnishing units in printing presses to determine or predict the varnish consumption, since the varnish consumption is normally not directly measured by a sensor.

However, the varnish consumption determination is technically important, in order, for example, to determine leaks, to be able to carry out pump monitoring and for the optimization of washing cycles and varnish changes in the machine, in order to avoid drying out and accumulation of varnish residues.

German Patent Application DE 10 2015 223 032 A1, corresponding to U.S. Pat. No. 9,802,420, discloses a method for the detection of ink leakage during a printing process in an inkjet printing press having a workflow system on a computer for monitoring the print job, an ink supply unit for the printing press with an ink tank with a level sensor, and a control computer with software controlling the ink supply unit, wherein the ink supply unit is capable of producing ink droplets of different sizes. The method includes the following steps: calculating a theoretically consumed quantity of ink from the printing data for the prepress stage by summing the droplet volumes by using the workflow system, transmitting the theoretically consumed quantity of ink to the software for controlling the ink supply by using the workflow system, determining a really consumed quantity of ink by analyzing the level sensor of the ink tank, comparing the theoretically consumed quantity of ink with the determined real consumed quantity of ink, and displaying a leakage alarm if the really consumed quantity of ink is higher than the theoretically consumed quantity of ink. In that case, however, the presence of a level sensor is necessary, which is just not present in varnishing units. In addition, that publication discloses nothing relating to big-data applications and appropriate evaluation of the data.

For that purpose, German Patent Application DE 10 2015 101 370 A1, corresponding to U.S. Pat. No. 10,551,799 and many others, discloses a big-data network or system for a process control system, or a process control system, including a data memory which is configured to receive process control data from control system devices and to store the process control data. The big data network or system identifies various parameters or attributes from the process control data and produces and uses line keys in order to store the parameters in accordance with various combinations, such as combinations using time stamps. The big data network or system can additionally store specific combined data analyses which are linked by the time periods defined by the time stamps. Accordingly, the big data network or system effectively stores real-time data which have dimensions in a data bank scheme, and users or administrators can use the combined data effectively in order to analyze specific data linked by the determined time periods. However, that publication discloses nothing about the application of the big data network with regard to the operation of varnishing units in printing presses and thus, regarding that point, discloses no gain in knowledge.

Furthermore, German Patent Application DE 10 2014 217 775 A1 discloses a method for determining a total quantity of a consumption of at least one coating medium that accumulates during at least one printing operation, wherein raster data is generated from original image data, the total quantity is calculated exclusively from data derived from the original image data, in the printing operation, individual image elements are to be generated by individual droplets of the at least one coating medium that are to be applied, the raster data for each image element has an entry with a value from multiple possible values, which value defines a respective droplet size and thus the respective individual quantity of coating medium of the droplet corresponding to the respective image element, from the multiple possible values, at least two different values are assigned to different droplet sizes, each different from zero, and the total quantity corresponds to a sum of all of the individual quantities respectively defined in the raster data of the droplets of the at least one coating medium that correspond to the respective image elements. That method is already clearly more helpful but still has distinct disadvantages. For example, the calculation method for the consumption prediction is quite specifically tailored to coating media for printing substrates of an inkjet printing process, wherein, although the coating medium is also designated as a varnish, the pre-treatment of the substrate before the inkjet printing is primarily meant. Classic varnish finishing following printing is therefore not covered. In addition, that publication also discloses nothing about the application and the specific advantages of the use of big-data applications.

SUMMARY OF THE INVENTION

It is accordingly an object of the invention to provide a method for operating a printing material processing machine by applying a varnish consumption prediction, which overcomes the hereinafore-mentioned disadvantages of the heretofore-known methods of this general type and which improves the operation of the machine with regard to the provision and use of consumable materials.

With the foregoing and other objects in view there is provided, in accordance with the invention, a method for operating a printing material processing machine by using a computer, which comprises the steps of acquiring print job parameters from print jobs for the printing material processing machine and machine parameters by using the computer, evaluating the acquired parameters to determine the machine state by using the computer, requesting and providing fluid consumable materials for optimizing the operation of the machine on the basis of the determined machine state by using the computer, and carrying out maintenance measures, optimized on the basis of the determined machine state, by using the computer.

The core of the method according to the invention is the evaluation of the acquired parameters for determining the machine state. In this case, the machine state is understood primarily to mean the current state of the machine with regard to the consumable materials. New consumable materials are then requested and provided accordingly on the basis of the machine state to be determined, i.e. the supply situation of the machine with consumable materials. This is done in such a way that the operation of the machine is not restricted in any way, such as would be the case, for example, if specific fluid consumable materials were not to be available at short notice. On the other hand, an oversupply with consumable materials can quite possibly represent a problem, and this is also avoided by the inventive evaluation and determination of the machine state based thereon and the requesting and providing of fluid consumable materials. Depending on the correspondingly determined machine state, it is additionally possible to carry out optimized maintenance measures, which likewise improve the operation of the machine. This relates, for example, to the time at which maintenance measures are carried out, but also the type of maintenance measure, i.e. which maintenance measure must be carried out at all at which time. As opposed to the method known from the prior art, in this case the acquired parameters, which are the starting point of the whole method according to the invention, are not acquired primarily by using sensors but are carried out merely by detecting print job parameters and machine parameters. In particular, the consumption data of the relevant machine is not measured directly.

Advantageous and therefore preferred developments of the invention can be gathered from the associated dependent claims and from the description with the associated drawings.

One preferred development of the method according to the invention is that the computer for requesting and providing fluid consumable materials on the basis of the determined machine state carries out a consumption prediction of the fluid consumable materials by using a regression model. The computer carries out the consumption prediction by applying the regression model in such a way that, by using the acquired print job and machine parameters, it firstly determines the current machine state, in particular with regard to the status of the consumable materials, and at the same time creates the consumption prediction for the fluid consumable materials from that data by using the regression model.

A further preferred development of the method according to the invention is that the computer uses a linear regression model or a self-learning model, in particular with an SVM, for the regression model for the consumption prediction of the fluid consumable materials. Which of the two approaches is more suitable in this case depends firstly on the capabilities and possibilities of the corresponding software developer who has to implement the computer-aided method in the software and secondly on the type and quantity of data that is available. The more data that is available with regard to the acquired print job and machine parameters, the more the application of a self-learning algorithm, for example in the form of a support vector machine (SVM) or an artificial neural network is recommended, since this operates better and more efficiently, when more data is available for the training.

A further preferred development of the method according to the invention is that the fluid consumable materials are varnish for a varnishing unit, ink for a printing unit or dampening solution for a dampening unit of the printing material processing machine. Primarily, the fluid consumable materials are varnish for a varnishing unit. This is the case because the varnish for the varnishing unit is transported to the varnishing unit in individual varnish containers and is usually not tracked by level sensors in the varnishing unit. Therefore, for the consumption monitoring of the varnish, there is always only a very rough and ready system available, since in practical use a new varnish container is always ordered only when the varnish in the varnishing unit approaches the end visibly to the printer. In this case, the method according to the invention therefore permits a considerable improvement in the consumption control, in that, by using the consumption prediction, it becomes considerably more accurately visible to the printer how the consumption of varnish develops over the operation of the printing material processing machine, and thus optimized operation of the machine with regard to requesting and providing new varnish containers and optimized maintenance measures dependent thereon is made possible. Accordingly, the approach of the method according to the invention is of course also possible for other fluid consumable materials such as ink for a printing unit or dampening solution for a dampening unit of the printing material processing machine.

A further preferred development of the method according to the invention is that the print job and machine parameters are parameters such as the area coverage of the print job, the corresponding printing time, the job length, the temperature in the printing material processing machine or the engraved roller type being used. These are the most important print job and machine parameters which are evaluated by the computer for determining the machine state and find entry into the regression model. However, the listing is not complete. It may be entirely practical to incorporate further parameters as well. In particular, when a self-learning algorithm or regression model is used, the principle applies that the more data is available, the more accurate the consumption prediction created by the self-learning regression model becomes and the more efficient the operation of the printing material processing machine will be.

A further preferred development of the method according to the invention is that the optimized maintenance measures include the performance of washing cycles and varnish or ink changes in the machine, in order to avoid drying out and accumulation of varnish or ink residues. This is important in particular for the fluid consumable materials of varnish and ink. In particular, varnish drying out in the varnishing unit could otherwise represent a great problem for the operation of the printing material processing machine.

A further preferred development of the method according to the invention is that the determination of the machine state by the computer also includes the examination for possible leakage, and pump monitoring. This is recommended since, assuming the case in which the consumption prediction operates correctly, in practice a substantially higher consumption on a printing material processing machine, as compared with the predicted consumption, indicates that there must be a leak somewhere in the machine. This likewise applies to monitoring the corresponding pumps for the fluid consumable materials.

Other features which are considered as characteristic for the invention are set forth in the appended claims.

Although the invention is illustrated and described herein as embodied in a method for operating a printing material processing machine by applying a varnish consumption prediction, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

The invention provides that, firstly, data from the prepress stage relating to the respective print job parameters and, secondly, data from the stock in storage about the removal of the fluid consumable materials, primarily varnish but also ink or dampening solution, is processed, with the aim of producing an accurate consumption model.

Figure 3:
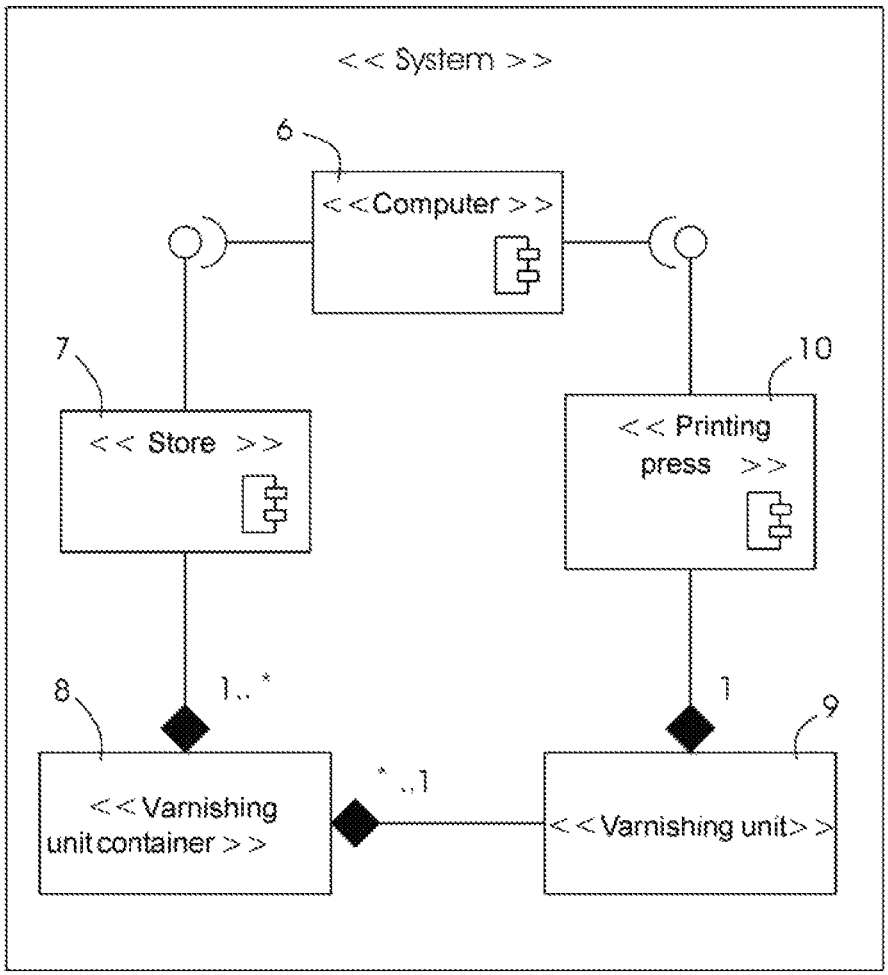
FIG. 3 is a block diagram showing a structure of a logistics system between a printing press and a storage area or stockpile.

Referring now to the figures of the drawings in detail and first, particularly, to FIG. 3 thereof, there is seen a block diagram of the structure of a logistics system between a printing press 10 and a storage area or stockpile 7. A computer 6, which has access to the data of all of the components involved, acquires all of the important consumption data of the printing press(es) 10 being used, and the storage data. In the case of varnish as a fluid consumable material, varnish is used in a varnishing unit 9 of the printing press 10. Once the supply is exhausted, a further varnish container 8 from the storage area or storeroom 7 must be organized in order to appropriately fill up the storage area of the varnishing unit 9 again. The varnish consumption of the printing press 10 depends on various print job parameters, which also means the machine parameters of the printing press 10 to be used.

Important print job parameters are, for example, the subject occupancy in the form of the percentage area coverage, the format, the printing substrate and in this case, in particular, the surface condition, the setting behavior and the absorption behavior, the varnish/ink/dampening solution type with respect to manufacturer, type, name, batch, the pressure, the varnishing plate in the case of varnish, or, in the case of ink, the printing plate with respect to manufacturer, type, name, batch, the engraved roller being used, for example with reference to the cell size or the temperature in the varnishing/ink/dampening unit, and the printing speed.

Necessary data from the stock in the storage area or warehouse relate primarily to the removal time and quantity for new varnish containers 8 or ink or dampening solution containers and the corresponding varnish, ink or dampening solution grade, which also in this case include data relating to the manufacturer, type, name, batch, for a correct assignment.

Starting from the assumption that a new container is always removed when the old container 8 is empty, the overall varnish consumption can thus be determined over a relatively long time period. Possible quantities of residues or losses are thus included, but this is intended, since the actual varnish consumption is to be determined.

The modeling is most illustrative if the sum of the varnish consumed, for example over a year, is divided by the sum of the area printed in this year. This is the average varnish consumption per unit area printed. This will include all of the quantities of varnish: the varnish on the paper, varnish residues in the machine 10, varnish residues in the container 8, quantities of varnish washed away, etc. The same also applies to ink and dampening solution but, for simplicity, mention will be made only of varnish below.

This simple conceptual model becomes more detailed and improved step-by-step by applying big-data solutions, so that at the end a computer-assisted model is created which, depending on the aforementioned parameters, depicts the varnish consumption as accurately as possible for an individual printing press 10.

In detail, a mathematical regression model which couples the relationships between the print job parameters and the real varnish consumption is preferably adapted by a computer 6. The input variables are the print job parameters, which can be of a continuous nature (subject occupancy, job length, temperature) or categorical (engraved roller type). The output variable is the storage removal of the varnish, preferably in liters (L). Alternatively, in a further preferred construction variant, if sufficient data is present, a machine learning algorithm, in particular in the form of a support vector machine, can also be used by the computer 6.

A basic precondition for the creation and application of the consumption model is the access to the data of the stock in the storage area and the print job parameters over a long time period and for a large machine group, so that a suitably large data base (big data) is available.

By using such a model, the computer 6 can firstly optimize the stock in the storage area. Furthermore, the varnish consumption prediction is important in order to determine leakages, to be able to carry out pump monitoring and to improve pump utilization and construction for future development.

In addition, use can be made of the knowledge in order to optimize washing cycles and varnish changes in the printing press 10, and to avoid the drying out and accumulation of varnish residues in the varnishing unit 9.

The method according to the invention will be explained in more detail below in its preferred structural variant, by using a fictitious example with appropriate data.

With respect to the data and preconditions from which the consumption model was created, the following assumptions are made for the example:

1. Three different engraved roller types with different varnish consumption quantities, which have a different temperature dependence, are available.
2. An unknown quantity of leakage is assumed.
3. 100,000 print jobs with job lengths of 100 to 10,000 with a known date/time of day for the processing are available.

4. For the processing of these print jobs, 6000 removals of varnish from the storage area with a known date/time of day are forecast by the model created.

The data is managed by the computer in a database, wherein the data is preferably organized as follows:

Print Job Data/Machine Data:

| Date | Time | Length | Coverage | Temperature | RW |
|---|---|---|---|---|---|
| Aug. 3, 2019 | 11:33:43 | 5082 | 0.83734 | 30.534013 | V1 |
| Aug. 3, 2019 | 11:48:07 | 5411 | 0.153003 | 36.07285 | V1 |
| Aug. 3, 2019 | 12:02:31 | 9182 | 0.557279 | 33.62523 | V1 |
| Aug. 3, 2019 | 12:16:55 | 3269 | 0.405539 | 30.160181 | V3 |
| Aug. 3, 2019 | 12:31:19 | 8841 | 0.862206 | 22.781552 | V1 |
| Aug. 3, 2019 | 12:45:43 | 7104 | 0.496435 | 25.569903 | V2 |
| Aug. 3, 2019 | 13:00:07 | 5634 | 0.441237 | 31.200093 | V2 |
| Aug. 3, 2019 | 13:14:31 | 5983 | 0.669666 | 33.003459 | V2 |
| Aug. 3, 2019 | 13:28:55 | 814 | 0.848586 | 29.058173 | V2 |
| Aug. 3, 2019 | 13:43:19 | 9006 | 0.548472 | 33.48739 | V1 |

Storage Data Regarding Varnish:

| Date | Time |
|---|---|
| Aug. 3, 2019 | 11:33:43 |
| Aug. 3, 2019 | 13:28:55 |
| Aug. 3, 2019 | 16:43:19 |
| Aug. 3, 2019 | 19:11:10 |
| Aug. 3, 2019 | 22:43:59 |

The varnish data is prepared by the computer 6 in such a way that a realistic consumption can be determined from the data. Every time the volume of varnish in the tank falls below a value of 25 l, a "refill" is triggered. The input value for the regression or machine learning algorithm is the time between two varnish refills.

Figure 1:
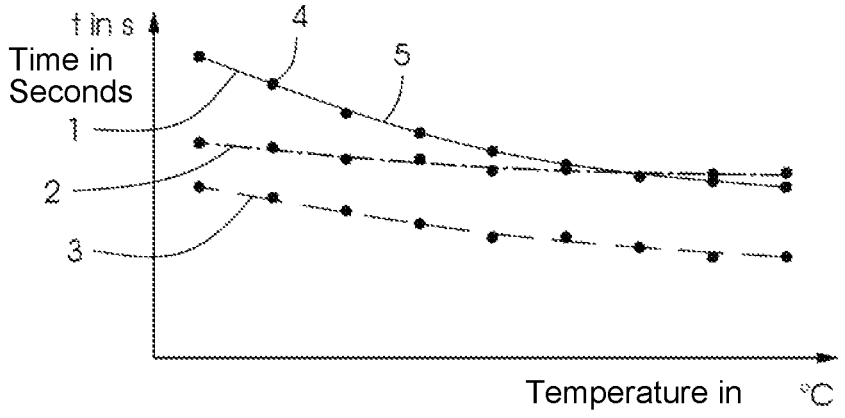
FIG. 1 is a diagram showing an example of a result of a consumption prediction in the form of a time to change a container, depending on temperature.

For this case, the consumption prediction model, both in the form of a classic linear regression and in the form of a self-learning algorithm, such as a support vector machine or an artificial neural network, is easily capable of concluding the real varnish consumption from that data. The three lines illustrated in FIG. 1 are consumption curves 1, 2, 3 for the three different engraved roller types. The lines themselves indicate the real consumption values 4 without quantities of leakage and losses. The data points in the consumption curves 1, 2, 3 are the modeled consumption values 5 supplied by the model, i.e. the varnish refill times. Both the real consumption values 4 and the modeled consumption values 5 in the present example depend on the temperature in the varnishing unit. In this case, according to the values used, the temperature ranges lie in the range from 20 to 40° C. Given other data in other embodiments, corresponding other dependencies of course exist.

Figure 2:
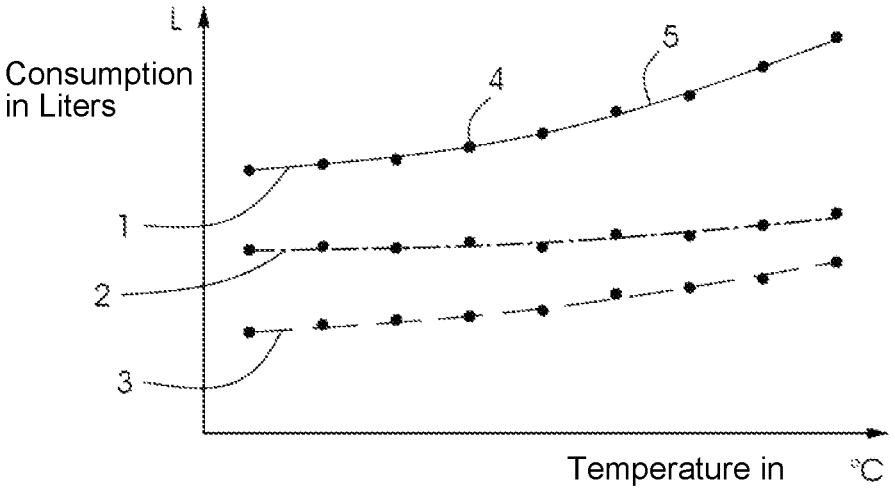
FIG. 2 is a diagram showing an example of a result of a consumption prediction in the form of a consumption in liters, depending on temperature.

In FIG. 2, the same fact is illustrated once more in the form of the varnish consumption in liters, depending on the temperature.

The following is a summary list of reference numerals and the corresponding structure used in the above description of the invention:

1 Time/temperature consumption curve for first engraved roller
2 Time/temperature consumption curve for second engraved roller
3 Time/temperature consumption curve for third engraved roller
4 Real consumption values
5 Modeled consumption values
6 Computer
7 Storage area
8 Varnishing unit container
9 Varnishing unit of a printing press
10 Printing press

The invention claimed is:

1. A method for operating a printing material processing machine, the method comprising the following steps:

using a computer to acquire print job parameters from print jobs for the printing material processing machine and from machine parameters;

selecting the print job parameters and the machine parameters as an area coverage of the print job, or a corresponding printing time, or a job length, or a temperature in the printing material processing machine or an engraved roller type being used;

using the computer to evaluate the acquired parameters to determine a machine state;

using the computer to request fluid consumable materials for optimizing operation of the machine based on the determined machine state to carry out a consumption prediction of the fluid consumable materials by using a regression model;

providing varnish for a varnishing unit, ink for a printing unit or dampening solution for a dampening unit of the printing material processing machine, as the fluid consumable materials; and using the computer to carry out maintenance measures on the machine being optimized based on the determined machine state.

2. The method according to claim 1, which further comprises causing the computer to use a linear regression model or a self-learning model for the regression model for the consumption prediction of the fluid consumable materials.

3. The method according to claim 2, which further comprises using a support vector machine for the linear regression model or self-learning model.

4. The method according to claim 1, which further comprises selecting the optimized maintenance measures as a performance of washing cycles and varnish or ink changes in the machine, in order to avoid drying out and accumulation of varnish or ink residues.

5. The method according to claim 1, which further comprises carrying out an examination for possible leakage and pump monitoring in the determination of the machine state by the computer.

* * * * *